US008708514B2

(12) United States Patent
Downey

(10) Patent No.: US 8,708,514 B2
(45) Date of Patent: Apr. 29, 2014

(54) PORTABLE DEVICE FOR HANDS-FREE ILLUMINATION

(76) Inventor: Alan B. Downey, Spicewood, TX (US)

( * ) Notice: Subject to any disclaimer, the term of this patent is extended or adjusted under 35 U.S.C. 154(b) by 289 days.

(21) Appl. No.: 13/292,973

(22) Filed: Nov. 9, 2011

(65) Prior Publication Data

US 2013/0114248 A1 May 9, 2013

(51) Int. Cl.
*F21V 21/08* (2006.01)

(52) U.S. Cl.
USPC ..... 362/157; 362/190; 362/105; 362/164; 362/169

(58) Field of Classification Search
USPC ..... 362/157, 164, 169, 190, 191, 205, 105, 362/106
See application file for complete search history.

(56) References Cited

U.S. PATENT DOCUMENTS

| | | | | |
|---|---|---|---|---|
| 3,804,411 | A * | 4/1974 | Hendry | 473/570 |
| 5,183,324 | A * | 2/1993 | Thomas | 362/103 |
| 5,558,428 | A * | 9/1996 | Lehrer et al. | 362/105 |
| 6,641,293 | B2 | 11/2003 | Kumar et al. | |
| 6,719,437 | B2 * | 4/2004 | Lary et al. | 362/106 |
| 6,758,582 | B1 | 7/2004 | Hsiao et al. | |
| 6,957,902 | B2 | 10/2005 | Kim | |
| 7,275,841 | B2 | 10/2007 | Kelly | |
| 7,922,366 | B2 | 4/2011 | Li | |
| 2002/0186557 | A1 * | 12/2002 | Lary et al. | 362/106 |
| 2003/0185012 | A1 | 10/2003 | Sitzema, Jr. et al. | |

* cited by examiner

*Primary Examiner* — Anabel Ton
(74) *Attorney, Agent, or Firm* — Cesari & Reed LLP; R. Michael Reed

(57) ABSTRACT

A portable device for hands free illumination includes a battery pack and a lamp assembly coupled to the battery pack to receive power. The lamp assembly includes a housing defining an opening extending along at least a portion of two sides and defining an enclosure, a light source within the enclosure and coupled to the battery pack to receive power, and a transparent cover sized to fit over the opening to seal the enclosure and to permit light to pass through in at least two directions.

21 Claims, 5 Drawing Sheets

PORTABLE DEVICE FOR HANDS-FREE ILLUMINATION

FIELD

The present disclosure is generally related to portable lamps, and more particularly, to portable devices for hands-free illumination.

BACKGROUND

Portable illumination devices, such as flashlights and head lamps that can be worn, for example, on the helmet of a miner or cave explorer, typically emit light in a forward direction or in a forward direction and to the sides. Some devices include adjustable features to allow the user to pivot, focus, and/or direct the illumination, allowing the user to adapt a limited (focused or directed) emitted-light pattern to best suit the user's situation. Unfortunately, such limited emitted-light pattern produces "tunnel vision" effects, in which only a very narrow central region of vision remains due to the limited illumination.

SUMMARY

In an embodiment, a portable device for hands free illumination includes a helmet configured to be worn on a user's head, a battery pack coupled to a rear portion of the helmet, and a lamp assembly coupled to a front portion of the helmet. The lamp assembly is coupled to the battery pack to receive power. The lamp assembly includes a housing defining an opening extending along at least a portion of two sides and defining an enclosure, a light source within the enclosure and coupled to the battery pack to receive power, and a transparent cover sized to fit over the opening to seal the enclosure and to permit light to pass through in at least two directions.

In another embodiment, a portable device for hands-free illumination includes a housing having at least one sidewall defining an enclosure with an opening on an end. The opening extends at least partially along a portion of the at least one sidewall. The portable device further includes at least one light source disposed within the enclosure and configured to emit light through the opening in a first direction and a second direction.

In still another embodiment, a portable device includes a housing having at least one sidewall defining a cavity, and an interior wall extending substantially perpendicular to the at least one sidewall to divide the cavity into a first enclosure having a first opening and a second enclosure having a second opening. The portable device includes a first cover sized the first opening and to mate with the at least one sidewall to seal the first enclosure and a transparent cover sized to fit the second opening to seal the second enclosure. The portable device further includes a control circuit within the first enclosure and at least one light source disposed within the second enclosure and coupled to the control circuit through the interior wall. The at least one light source is responsive to signals from the control circuit to emit light through the transparent cover.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of a portable illumination system are described below that are configured to direct light in a first direction and to simultaneously direct or allow light to illuminate a surface in a second direction. In an embodiment, the housing of the portable illumination system is configured to be worn as a headlamp and to provide simultaneous lighting in both the forward and downward directions. In an embodiment that is designed for underground activities, such as mining or cave exploration, the light source can be a light emitting diode (LED) surrounded by a durable, substantially aluminum shroud.

In an example, the portable illumination system includes a housing defining at least one enclosure for securing a light source and including a transparent cover configured to permit light to pass through to illuminate surfaces. In some instances, the cover may include transparent portions and opaque portions for emitting light in two directions. For a head-worn implementation, the portable illumination system simultaneously emits light in a forward direction and in a downward direction towards the ground, creating an ambient cast of light in the area below the user's head.

In general, as used herein, the term "portable" refers to a characteristic of an object that allows it to be carried in the user's hand or worn by the user as he or she moves about. The term "hands free" refers to the wearable or mounting capability of the illumination system (as discussed below with respect to FIGS. 1 and 16), which allow the illumination system to be worn by the user (such as on his/her helmet) or mounted to an object to allow the user to make use of the illumination without having to hold the illumination system. In some instances, straps or other attachment means may be provided that allow the user to releasably attach the portable illumination system to an object, such as a pole, the user's arm, the user's belt loop, a backpack strap, or to some other object. An example of a portable illumination system mounted to a protective helmet is described below with respect to FIG. 1.

Figure 1:
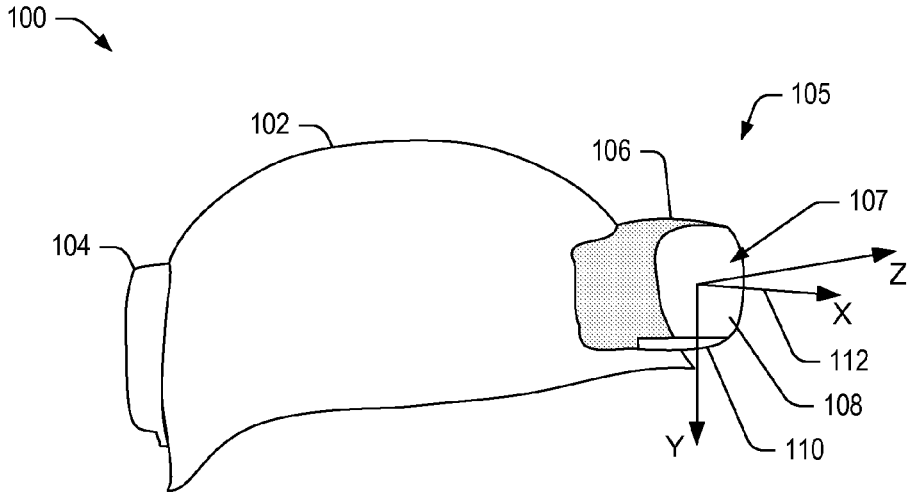
FIG. 1 is a perspective view of a protective system including a caving helmet having a portable illumination system configured to emit light in forward and downward directions simultaneously.

FIG. 1 is a perspective view of a protective system 100 including caving helmet 102 having a portable illumination system configured to emit light in forward and downward (X and Y) directions simultaneously. The portable illumination system includes a battery pack 104 and a lamp assembly 105 including a housing 106 and a transparent cover 107 including a front portion 108 and a bottom portion 110 to allow emitted light to pass through an opening in housing 106 in at least two directions (an X-direction and a Y-direction) as indicated by axis 112. The front portion 108 extends in a first plane (Y-Z Plane) and a bottom portion 110 extends in a second plane (X-Z Plane). In an alternative embodiment, the bottom portion 110 defines a plane that extends at an angle greater than zero relative to the front portion 108. Battery pack 104 is connected to lamp assembly 105 by wires (not shown), which may extend through openings in caving helmet 102 or may extend over or under the caving helmet to supply power to a light source within the lamp assembly 105.

In an example, housing 106 can be formed of a single, unitary piece of durable, rigid material, such as a metal or a thermoplastic polymer (such as polyvinyl chloride or PVC). Transparent cover 107 can be formed from a rigid, transparent material, such as glass, clear ceramic, or polycarbonate material. In an embodiment, the transparent cover 107 is formed from transparent polycarbonate material having a thickness of approximately three millimeters.

Housing 106 can be manufactured in any shape, including a rectangular shape having four sides, a substantially circular or elliptical shape or another shape that allows the emitted light to pass through the transparent cover 107 in at least two directions. In the illustrated example, housing 106 has one sidewall that extends in the Y-direction and horizontally in the X-direction and Z-direction to form a protective shield for the light source while providing an opening that is sealed by the transparent cover 107 for the emission of light there through. By allowing light to pass through in both the X-direction and the Y-direction, lamp assembly 105 illuminates the area in front and at the feet of the wearer, reducing the "tunnel effect" provided by unidirectional illumination sources and enhancing safety for the user by illuminating his/her walking path.

In an example, the transparent cover 107 is formed from clear-sided lenses configured to modify and focus the light into a beam. The clear lenses are usually about 90% efficient with respect to the light that is focused and directed in the X-direction (i.e., the light that is cast in a forward direction). The remaining 10% of the light is reflected and/or emitted to the sides (in the Z-direction) and downward (in the Y-direction), which conventionally would be lost within the housing, but which is emitted through the transparent cover 107 in the Y-direction and/or in the Z-direction to provide multi-axial lighting.

While the illustrated example of FIG. 1 provides one possible context for using the portable illumination system (e.g., a protective helmet), the portable illumination system can be employed in other context, such as a shirt-worn or wrist-worn embodiment. Further, the portable illumination system can be constructed to allow for releasable attachment to objects or structures to provide desired illumination as needed. An example of one possible embodiment of a lamp assembly is described below with respect to FIG. 2.

Figure 2:
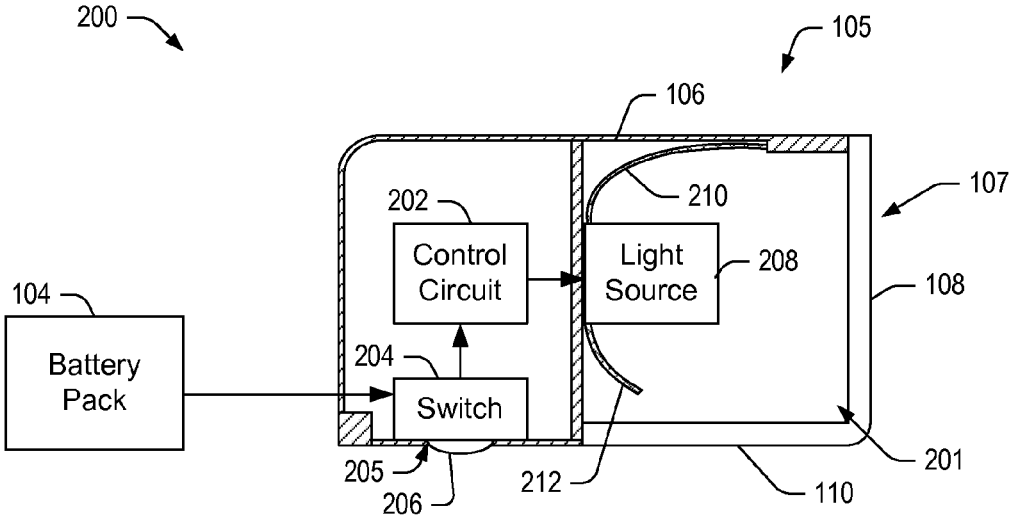
FIG. 2 is a cross-sectional view of a portable illumination system, which is one possible embodiment of the portable illumination system of FIG. 1.

FIG. 2 is a cross-sectional view of a portable illumination system 200, which is one possible implementation of the portable illumination system of FIG. 1. Lamp assembly 200 includes battery pack 104 and lamp assembly 105. Lamp assembly 105 includes a housing 106 having an interior wall 220 defining an electronics enclosure 222 and a lamp enclosure 224. The lamp enclosure 224 includes an opening 201, which is sealed by transparent cover 107.

Housing 106 further includes a grommet 205 extending through the sidewall of housing 106 into electronics enclosure 222, which encloses a control circuit 202 connected to a switch 204. Switch 204 includes a button 206 that extends at least partially through grommet 205 to allow user access to the switch 204. In the illustrated example, switch 204 selectively connects a power supply from battery pack 104 to control circuit 202, which is connected through interior wall 220 to a light source 208 within lamp enclosure 224. Further, lamp enclosure 224 includes reflector portions 210 and 212, which operate to direct emitted light from light source 208 in the X-direction and to allow at least some of the emitted light to continue in the Y-direction.

In an alternative embodiment, battery pack 104 may be integrated with housing 106 of lamp assembly 105. In another alternative embodiment, the power supply from battery pack 104 may be connected to a power control circuit of an integrated circuit that includes control circuit 202. In this alternative embodiment, the switch 204 may control delivery of the power supply to one or more light-emitting diodes (LEDs) of light source 208, making it possible for the user to selectively activate one or more of the LEDs by pressing switch 206 a selected number of times.

Figure 3:
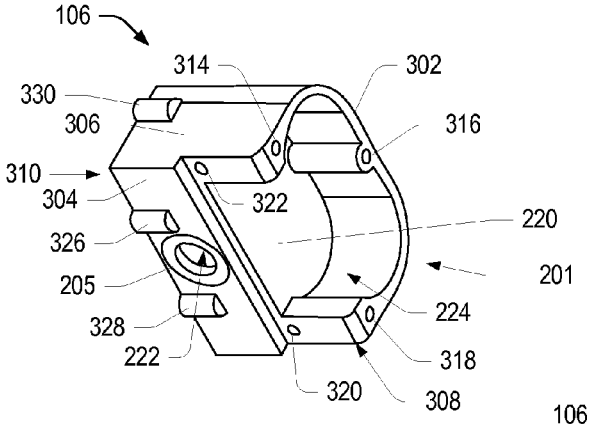
FIG. 3 is a perspective view of an embodiment of the housing for the lamp assembly of FIG. 1.
Figure 4:
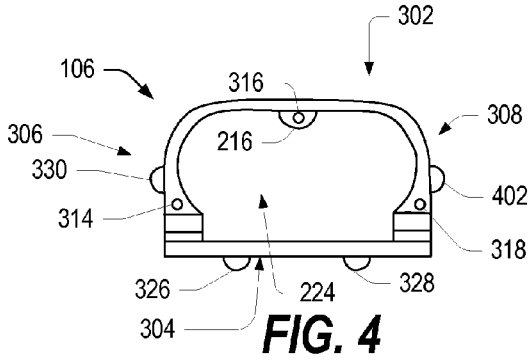
FIG. 4 is a front view of the housing of FIG. 3.
Figure 5:
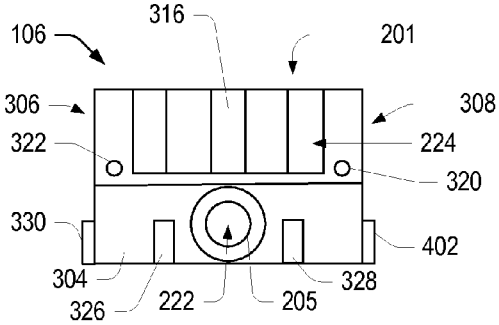
FIG. 5 is a bottom view of the housing of FIG. 3.

FIGS. 3-5 depict a perspective view, a front view, and a bottom view of the housing 106 of an embodiment of housing 106 for the lamp assembly 105 of FIG. 1. Housing 106 includes sidewalls 302, 304, 306, and 308 and an interior wall 220, which separates the housing into two enclosures: electronics enclosure 222 and lamp enclosure 224. Sidewalls 302, 304, 306, and 308 cooperate to define an opening 201. Housing 106 further includes a rear wall 310, which is releasably attached to sidewalls 304, 306, and 308 via receptacles 326 and 328 on sidewall 304, receptacle 330 on sidewall 306, and receptacle 402 (in FIG. 4) on sidewall 308. Receptacles 326, 328, 330, and 402 are configured to receive a screw or other releasable attachment means for securing a rear cover (not shown) to housing 106 to close the electronics enclosure 222.

Grommet 205 is formed in sidewall 304 to allow for user access to a button (such as button 206 in FIG. 2). Further, screw holes 322 and 314 are formed on the edges of sidewall 306 adjacent to opening 201. A screw hole 316 is formed on the inside of sidewall 302 adjacent to opening 201, and screw holes 318 and 320 are formed on the edges of sidewall 308 adjacent to opening 201. Screw holes 314, 316, 318, 320, and 322 are arranged to receive screws for securing transparent cover 107 over opening 201 to seal lamp enclosure 224.

Figure 6:
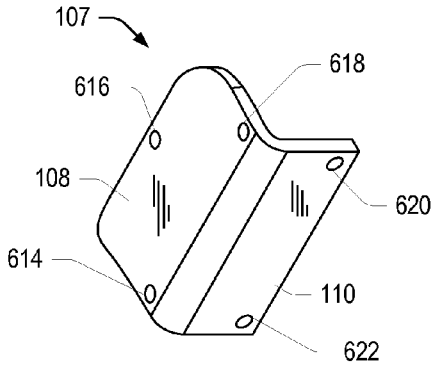
FIG. 6 is a perspective view of a transparent cover for the housing of FIG. 3.

FIG. 6 is a perspective view of a transparent cover 106 for opening 201 defined by the housing 106 of FIG. 3. Transparent cover 107 includes front portion 108 and bottom portion 110 for allowing light to pass through in two directions. Further, bottom portion 110 includes openings 620 and 622 configured to match openings 322 and 320, respectively, in housing 106 for receiving fasteners configured to secure transparent cover 107 to housing 106. Front portion 108 includes openings 614, 616, and 618 configured to match openings 314, 316, and 318 in housing 106 for receiving fasteners to secure the front portion of transparent cover 107 to housing 106. In an example, transparent cover 107 is formed from a unitary piece of transparent material machined to fit a curvature of housing 106.

Figure 7:
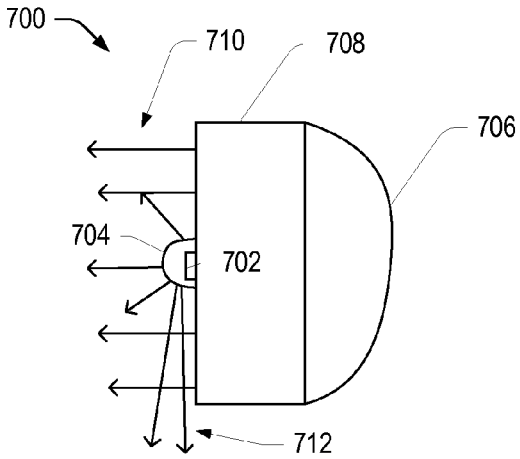
FIG. 7 is a side-view of an embodiment of a lamp for use with the portable illumination system of FIG. 1.

FIG. 7 is a side-view of an embodiment of a lamp 700 for use with the portable illumination system 200 of FIG. 2. Lamp 700 is one possible example of light source 208 in FIG. 2. Lamp 700 includes a light source 702 enclosed within a cover 704 (such as a bulb). Lamp 700 includes a parabolic portion 706 and a directional portion 708 which have substantially reflective surfaces for directing light emitted by light source 702 in a first direction 710. Further, because light source 702 extends past a peripheral edge of directional portion 708, at least a portion of the light emitted by light source 702 extends in a vertical direction as indicated generally at 712.

In the illustrated example, lamp 700 emits light that extends in at least two directions. In some instances, the directional portion 708 of lamp 700 includes a reflective surface or a portion of the housing 106 that extends along the top and side portions of the directional portion 708 to prevent the emitted light from scattering in all directions while allowing the emitted light to illuminate surfaces in the X-direction and Y-direction.

Figure 8:
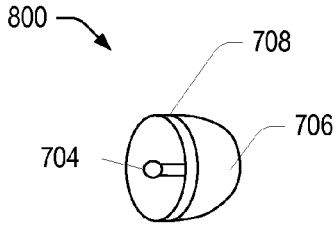
FIG. 8 is a perspective view of an embodiment of a lamp including a parabolic reflecting surface configured to direct light in a first direction.

FIG. 8 is a perspective view of an embodiment of a lamp 800 including a parabolic reflecting surface 706 and a directional portion 708 configured to direct light in a first direction. In this instance, the light source within cover 704 extends past the directional portion 708. Directional portion 708 and reflecting surface (parabolic portion) 706 directs a portion of the emitted light in a first direction. However, since the cover 704 extends past the directional portion, the light source emits light in other directions as well.

Figure 9:
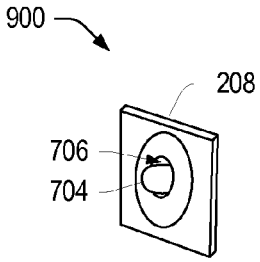
FIG. 9 is a side-view of a second embodiment of a lamp configured to provide illumination.

FIG. 9 is a side-view of a second embodiment of a lamp 900 configured to provide illumination. Lamp 900 includes a light source 208 including a reflecting surface (parabolic portion) 706 and a cover (or bulb) 704 extending beyond the edges of the reflecting surface 704, emitting light in multiple directions.

Figure 10:
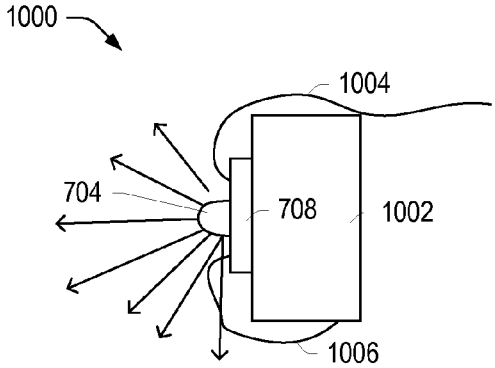
FIG. 10 is a perspective view of third embodiment of a lamp configured to provide illumination.

FIG. 10 is a perspective view of third embodiment of a lamp 1000 configured to provide illumination. Lamp 1000 includes a base portion 1002 that includes parabolic portion 706 within the base portion 1002. A directional portion 708 is connected to base portion 1002. The light source is connected to power source 104 by wires 1004 and 1006. Cover 704 extends past the peripheral edge of directional portion 708, thereby emitting light in multiple directions.

While the above-discussion has focused on parabolic and directional lamps for emitting light in multiple directions, it is also possible to provide a housing, such as housing 106, that includes an opaque outer cover with a reflective lining. A portion of the housing may be left transparent, as described below with respect to FIG. 11.

Figure 11:
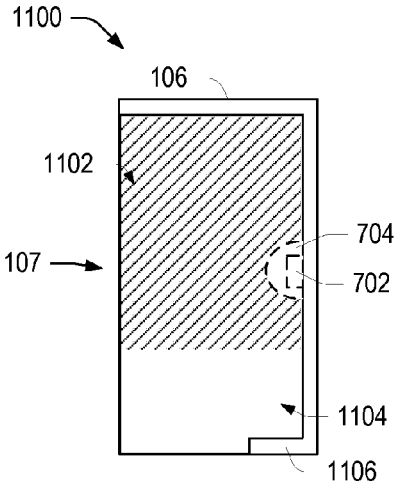
FIG. 11 is a side view of an embodiment of the portable illumination system of FIG. 1 including a transparent portion and an opaque portion.

FIG. 11 is a side view of an embodiment of the lamp assembly 105 of portable illumination system 200 of FIG. 2 including a transparent portion and an opaque portion. Lamp assembly 105 includes housing 106, which is opaque and includes a transparent cover 107 that is painted to provide an opaque portion 1102 and a transparent portion 1104. Lamp assembly 105 includes a light source 702 and a cover 704. In this instance, the opaque portion 1102 blocks and/or reflects emitted light from light source 702, while transparent portion 1104 allows the emitted light to pass through.

In some instances, in may be desirable to include an opaque lip portion 1106 on housing 106 to provide a "visor" for a user, particularly in the context of a head-worn portable illumination system so that the light is directed away from the user's eyes. Other shapes and/or embodiments may also be provided. An example of a substantially cylindrical light-directing element is described below with respect to FIG. 12.

Figure 12:
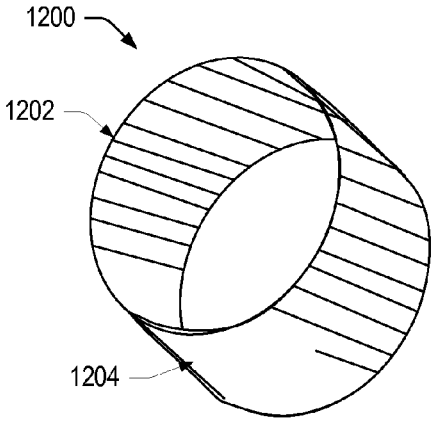
FIG. 12 is a perspective view of a light-directing element including an opaque portion and a transparent portion.

FIG. 12 is a perspective view of a light-directing element 1200 including an opaque portion 1202 and a transparent portion 1204. Light-directing element 1200 can be used as the directional element 708 in FIGS. 7-8 and 10. In this example, light-directing element 1200 includes an opaque portion 1202, which may be painted onto a transparent cover to block or reflect light, leaving an unpainted portion (transparent portion 1204) to allow light to pass through.

In an example, the light-directing element 1200 can be used as the housing 106. In this instance, at least a portion of housing 106 can be formed from a transparent material, and a paint or another opaque coating can be applied to housing 106 to provide an opaque portion 1202 while leaving other portions uncoated as transparent portions 1204.

While it is possible to utilize the housing 106 or directional portions 708 to direct the light, a parabolic reflector can be used that includes an opening to allow passage of light in two directions. One possible example is described below in FIG. 13.

Figure 13:
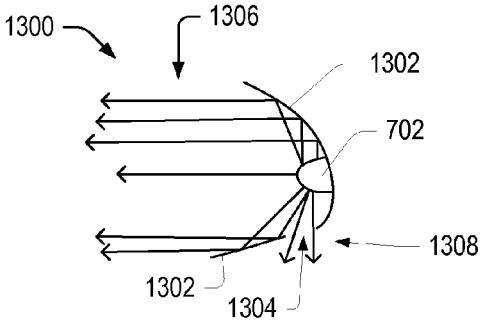
FIG. 13 is a diagram of a light source and a parabolic reflecting surface to direct light in a first direction and including an opening for allowing light to pass through in a second direction.

FIG. 13 is a diagram of a lamp 1300 including a light source 702 and a parabolic reflecting surface 1302 to direct light in a first direction (as generally indicated at 1306) and including an opening 1304 for allowing light to pass through in a second direction (as generally indicated at 1308). The opening 1304 provides a gap in the parabolic reflecting surface 1302 that permits some of the light to pass through. Another example of such a configuration is described below with respect to FIG. 14.

Figure 14:
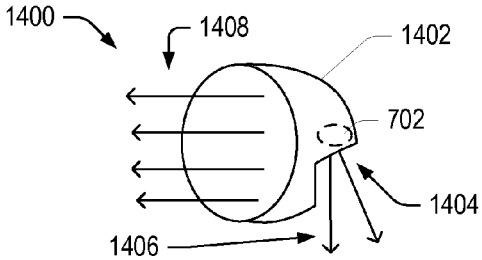
FIG. 14 is a diagram of a light source having a parabolic reflecting surface with an opening.

FIG. 14 is a diagram of a lamp 1400 including light source 702 and having a parabolic reflecting surface 1402 with an opening 1404. In this illustrated example, the opening 1404 allows light to pass through in range of directions (generally indicated at 1406) and the parabolic reflecting surface 1402 directs the remaining light in a first direction 1408.

While the above-discussion directs light using opaque surfaces and transparent areas, it is also possible to utilize reflecting surfaces to redirect light. One possible example is described below with respect to FIG. 15.

Figure 15:
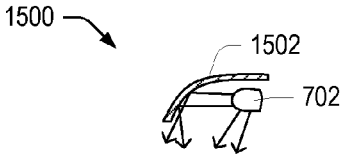
FIG. 15 is a diagram of a light source having a curved reflecting surface for directing light downward.

FIG. 15 is a diagram of a lamp 1500 including a light source 702 and a curved reflecting surface 1502 for directing light downward. In this instance, the curved reflecting surface 1502 can be used in conjunction a parabolic reflecting surface that directs light in a first direction and onto the curved reflecting surface 1502, which redirects the light downward.

Figure 16:
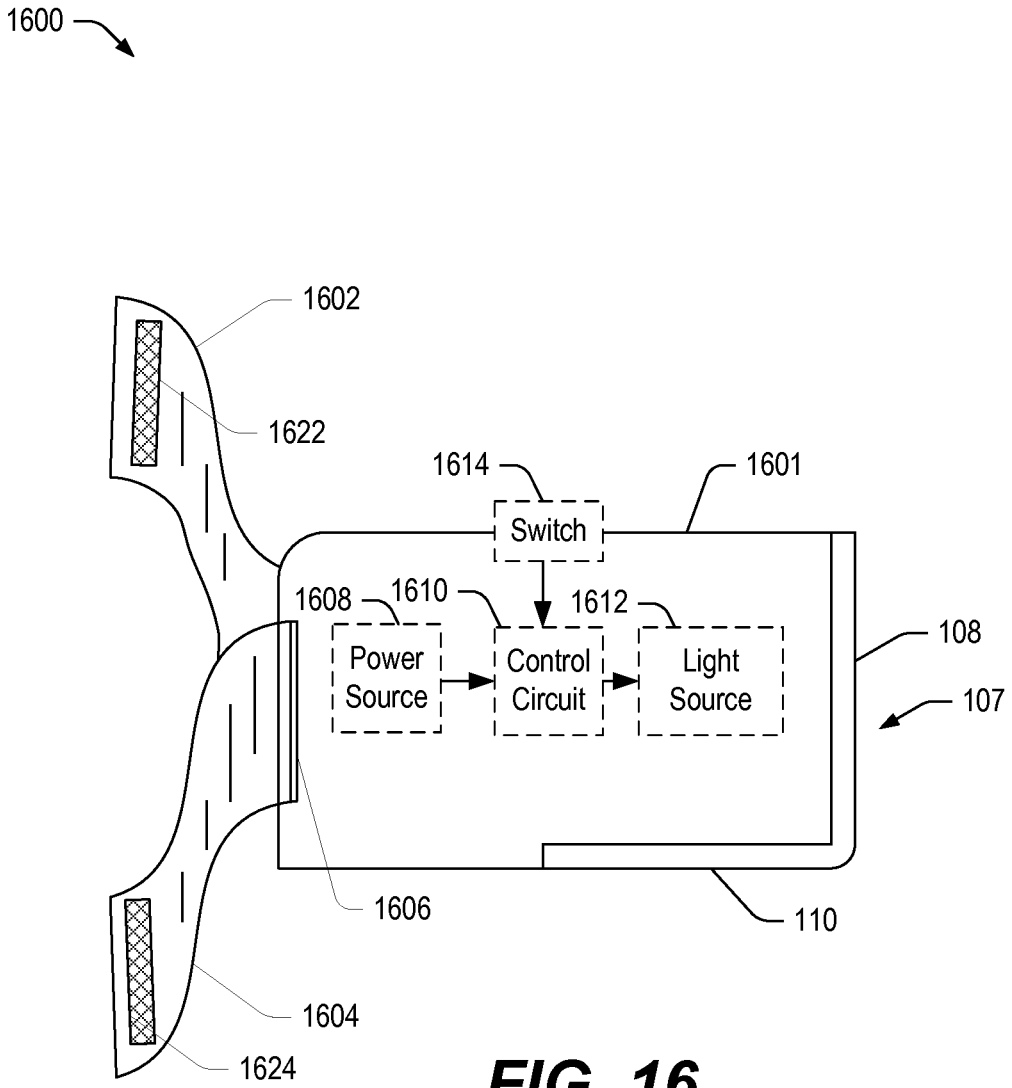
FIG. 16 is a diagram of an embodiment of an illumination system including a housing and including flexible straps for releasable attachment of the housing to an object.

FIG. 16 is a diagram of an embodiment of an illumination system 1600 including a housing 1601 and including flexible straps 1602 and 1604 for releasable attachment of the housing 1601 to an object. In an example, the housing 1601 may be releasable coupled to a post, a user's arm, or some other object or structure to provide temporary and/or portable illumination.

Housing 1601 can be a modified example of housing 106, wherein the battery pack 104 is replaced by power source 1608, which is incorporated within housing 1601. Power source 1608 provides power to light source 1612 through control circuit 1610, which is responsive to user-selection of a switch 1614 to activate/deactivate light source 1612. Housing 1601 further includes an opening that is covered by transparent cover 107, which allows light to pass through.

In the illustrated example, straps 1602 and 1604 include a hook-and-eye type of attachment structure 1622 and 1624, such as Velcro®, which can be connected to attach housing 1601 to a structure and released to remove the housing 1601.

Alternatively, ties, buckles, or other attachment elements may be used to couple housing 1601 to an object. Straps 1602 and 1604 may fed through a slot 1606 as depicted, or may be connected to housing 1601, depending on the implementation.

In conjunction with the illumination systems and lamps described above with respect to FIGS. 1-16, an illumination system is described that includes a power source and a lamp assembly, which is configured to direct light in two directions to illuminate a forward direction and a downward direction. In a head-worn implementation, the lamp assembly illuminates objects in front of the user and at the user's feet. However, it will be understood by one skilled in the art having the benefit of this disclosure that the portable illumination system may be carried by the user and/or mounted to an item of clothing or to the user's body, such as by straps, depending on the intended use and the specific implementation.

Although the present invention has been described with reference to preferred embodiments, workers skilled in the art will recognize that changes may be made in form and detail without departing from the scope of the invention.

What is claimed is:

1. A portable device for hands free illumination, the portable device comprising:

a battery pack; and a lamp assembly comprising:

a housing defining an opening extending along at least a portion of two sides and defining an enclosure;

a light source within the enclosure and coupled to the battery pack to receive power; and a transparent cover sized to fit over the opening to seal the enclosure and to permit light to pass through in at least two directions.

2. The portable device of claim 1, wherein the housing comprises:

at least one sidewall defining a cavity; and an internal wall to divide the cavity into the enclosure and a second enclosure.

3. The portable device of claim 2, further comprising a control circuit disposed within the second enclosure and coupled to the light source.

4. The portable device of claim 3, further comprising:

a grommet disposed on the at least one sidewall adjacent to the second enclosure; and a switch within the grommet, the switch accessible to a user to turn on the light source.

5. The portable device of claim 1, wherein the transparent cover is formed from a polycarbonate material.

6. The portable device of claim 1, wherein the transparent cover is formed from clear-sided lenses configured to modify and focus the light into a beam.

7. A portable device for hands-free illumination, the device comprising:

a housing including at least one sidewall defining an enclosure with an opening on an end, the opening extending at least partially along a portion of the at least one sidewall; and at least one light source disposed within the enclosure and configured to emit light through the opening in a first direction and a second direction.

8. The portable device of claim 6, further comprising a transparent cover sized to fit the opening and adapted to releasably attach to the housing to seal the enclosure.

9. The portable device of claim 7, further comprising:

a control circuit within the enclosure and coupled to and configured to control operation of the at least one light source.

10. The portable device of claim 9, further comprising a switch coupled to the housing and to the control circuit, the switch accessible by a user to control the at least one light source.

11. The portable device of claim 7, further comprising a second opening in the housing configured to receive at least one wire for providing a power supply to the at least one light source.

12. The portable device of claim 7, further comprising at least one reflective element configured to direct the light through the opening.

13. A portable device comprising:

a housing having at least one sidewall defining a cavity, an interior wall extending substantially perpendicular to the at least one sidewall to divide the cavity into a first enclosure having a first opening and a second enclosure having a second opening;

a first cover sized the first opening and to mate with the at least one sidewall to seal the first enclosure;

a transparent cover sized to fit the second opening to seal the second enclosure;

a control circuit within the first enclosure; and at least one light source disposed within the second enclosure and coupled to the control circuit through the interior wall, the at least one light source responsive to signals from the control circuit to emit light through the transparent cover.

14. The portable device of claim 13, wherein the transparent cover includes a first portion extending in a first direction and a second portion extending in a second direction at an angle greater than zero relative to the first direction.

15. The portable device of claim 13, wherein the transparent cover allows light to pass through in at least two directions.

16. The portable device of claim 13, wherein the at least one light source comprises a plurality of light-emitting diodes.

17. The portable device of claim 16, wherein the at least one light source comprises a parabolic reflecting surface configured to direct light from plurality of light-emitting diodes in a first direction.

18. The portable device of claim 17, wherein the parabolic reflecting surface includes an opening configured to allow the light to pass through in a second direction.

19. The portable device of claim 17, wherein at least one of the plurality of light emitting diodes extends past an edge of the parabolic reflecting surface to emit light in a second direction.

20. The portable device of claim 13, further comprising:

a directional component configured to reflect the light in a first direction; and wherein the directional component includes an opaque portion and a transparent portion.

21. The portable device of claim 1, wherein the housing further includes the battery pack.

* * * * *